US006007192A

United States Patent [19]

Ahn

[11] Patent Number: 6,007,192

[45] **Date of Patent: *Dec. 28, 1999**

[54] HEAD CARTRIDGE ASSEMBLY FOR INK-JET PRINTER

[75] Inventor: Byung-Sun Ahn, Suwon, Rep. of Korea

[73] Assignee: SamSung Electronics Co., Ltd., Suwon, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/861,690

[22] Filed: May 22, 1997

[30] Foreign Application Priority Data

May 22, 1996 [KR] Rep. of Korea ..... 96-17517

[51] Int. Cl.[6] ..... B41J 2/175

[52] U.S. Cl. ..... 347/87

[58] Field of Search ..... 347/85, 86, 87

[56] References Cited

U.S. PATENT DOCUMENTS

| | | | |
|---|---|---|---|
| 5,233,369 | 8/1993 | Carlotta et al. | 347/87 |
| 5,400,573 | 3/1995 | Crystal et al. | 53/468 |
| 5,488,400 | 1/1996 | Crystal et al. | 347/85 |
| 5,495,877 | 3/1996 | Schwenk et al. | 141/370 |
| 5,561,450 | 10/1996 | Brewster et al. | 347/49 |
| 5,572,245 | 11/1996 | Cowger | 347/44 |
| 5,572,852 | 11/1996 | Crystal et al. | 53/428 |
| 5,589,861 | 12/1996 | Shibata | 347/22 |
| 5,821,965 | 10/1998 | Oda et al. | 347/86 |

*Primary Examiner*—N. Le
*Assistant Examiner*—Michael Nghiem
*Attorney, Agent, or Firm*—Robert E. Bushnell, Esq.

[57] ABSTRACT

A head cartridge for an ink-jet printer is disclosed. This head cartridge includes an ink storage inside an ink vessel body, a flexible body installed inside the ink storage to hold and deliver ink, an ink filter located on the lower portion inside the ink storage, a heating device with heating elements located under the ink filter to heat and evaporate ink in the ink storage, a nozzle having a spray hole with multiple of apertures for spraying ink particles onto the print media by vapor pressure created by the heating device and a cap attached to the top of the ink vessel by an ultrasonic bonding process. An ink filling hole for the head assembly is located on the cap of the head cartridge, and a plug assembly is mounted on an opening formed on one side of the cap. In the plug assembly, a lid for plugging the ink filling hole, a projection used for fixing the plug assembly to the cap, and a locking portion for locking the head cartridge in a carriage of the printer's main body are integrally formed.

14 Claims, 3 Drawing Sheets

HEAD CARTRIDGE ASSEMBLY FOR INK-JET PRINTER

CLAIM OF PRIORITY

This application makes reference to, incorporates the same herein, and claims all benefits accruing under 35 U.S.C. §119 from an application for *Head Cartridge Assembly For Ink-Jet Printer* earlier filed in the Korean Industrial Property Office on May 22, 1996 and there duly assigned Ser. No. 17517/1996.

FIELD OF THE INVENTION

The present invention generally relates to an ink-jet printer. More particularly, it relates to a head cartridge assembly for an ink-jet printer which has an assembly for closing an ink filling hole located in the head cartridge and for locking the head cartridge into a print carriage within the printer's main body, and is a cartridge that can be reused by refilling ink after removing the assembly when the cartridge is empty.

BACKGROUND OF THE INVENTION

Sealing mechanisms are employed on cartridges for ink jet printers. For example, U.S. Pat. No. 5,572,852 for a *Method For Opening, Refilling and Sealing a Cartridge* and U.S. Pat. No. 5,400,573 for a *Kit and Method For Opening, Refilling and Sealing a Cartridge* to Crystal et al. both disclose a method for opening, refilling and sealing an ink cartridge. A spherical plug is used to reseal the opening after refilling the ink cartridge with ink.

U.S. Pat. No. 5,488,400 for a *Method For Refilling Ink Jet Cartridges* to Crystal et al. discloses another method for refilling ink jet cartridges and resealing them after being refilled An aperture used for refilling the cartridge with ink is sealed with a seal or plug after refilling the cartridge with ink.

U.S. Pat. No. 5,572,245 for a *Protective Cover Apparatus For An Ink-Jet Pen* to Cowger discloses a protective cover apparatus for ink jet pen. The protective cover apparatus is used to protect the ink pen head against damage caused by the ingress of dirt and debris, the accumulation of solidification of ink, and the like.

SUMMARY OF THE INVENTION

It is an object to provide a head cartridge for an ink-jet printer which has an assembly for preventing dirt from getting into an ink filling hole so as to avoid damage thereto.

It is another object to provide a head cartridge for an ink-jet printer which has an ink filling hole for refilling the proper ink into its ink storage using an ink injector, and an assembly for inserting into the ink filling hole. Users can buy the invented head cartridge and ink injector for further use, thus the present invention may create cost savings while increasing the reliability of the product.

It is yet another object to provide a plug for a cartridge of an ink jet printer that inserts into the ink filling hole and the plug is clipped on to the cartridge externally.

In order to realize the above objectives, the present invention involves a head cartridge for an ink-jet printer having an ink storage inside an ink vessel body, a flexible body installed inside the ink storage to hold and deliver ink, an ink filter located on the lower portion inside the ink storage, a heating device with heating elements located under the ink filter to heat and evaporate ink in the ink storage, a nozzle having a spray hole with multiple of apertures for spraying ink particles onto the print media by vapor pressure created by the heating device and a cap attached to the top of the ink vessel by an ultrasonic bonding process. An ink filling hole for the head assembly is located on the cap of the head cartridge, and a plug assembly is mounted on an opening formed on one side of the cap. In the plug assembly, a lid for inserting into the ink filling hole, a projection used for fixing the plug assembly to the cap, and a locking portion for locking the head cartridge in a carriage of the printer's main body are integrally formed.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
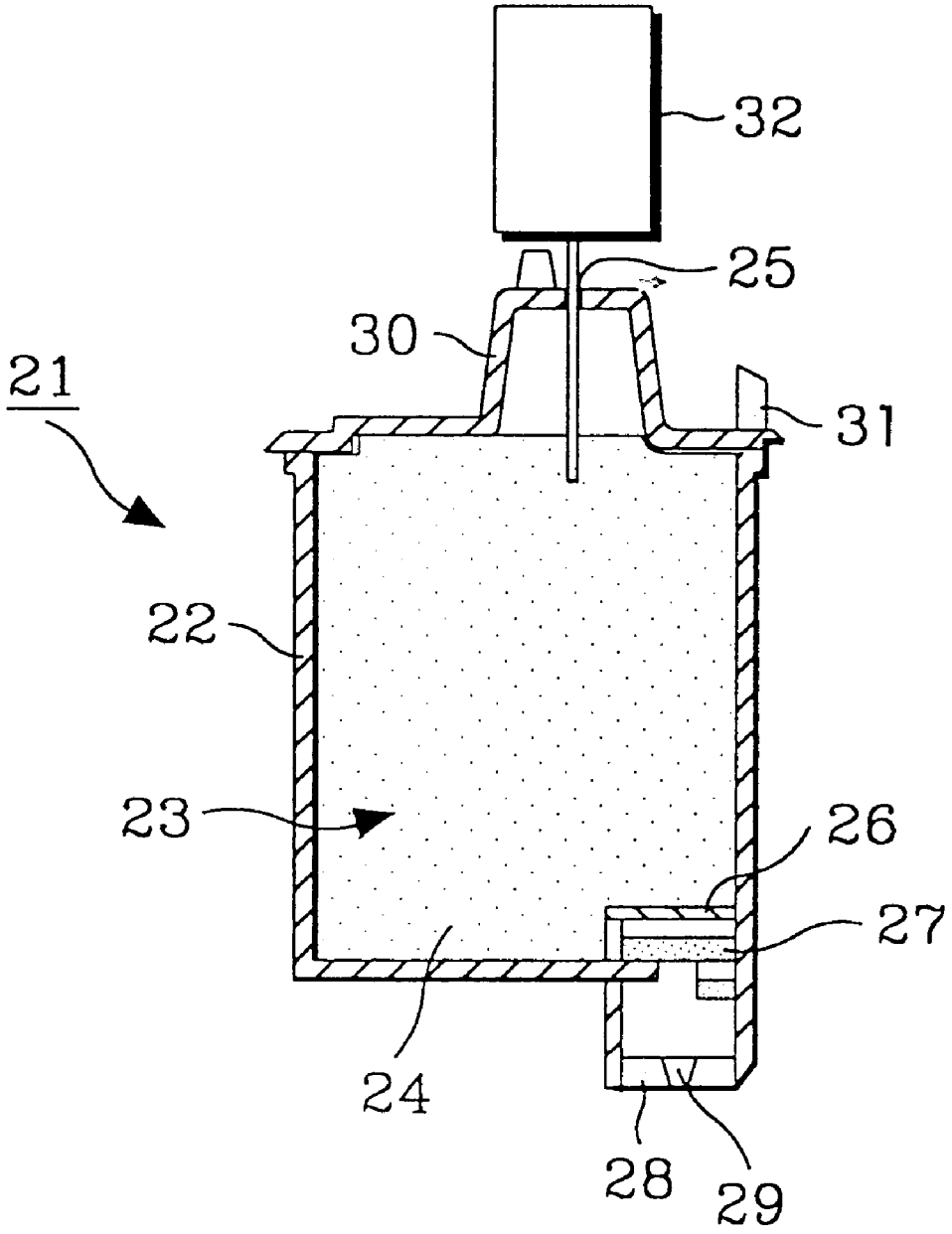
FIG. 1 depicts a head cartridge for an ink-jet printer.

A head cartridge 21, for an ink-jet printer, is installed on a carriage that slides right and left on a rail inside the printer's main body, and includes an ink storage 23 inside ink vessel body 22. A flexible body 24 is installed within ink storage 23, and an ink filter 26 is located on the bottom of the interior of ink storage 23. A heating device 27 and a nozzle 28 containing a spray hole 29 are located under ink filter 26. A cap 30 is attached to ink vessel body 22 by an ultrasonic bonding process. An ink filling hole 25 is drilled in the middle of cap 30, through which ink storage 23 is refilled with ink by ink injector 32. A locking portion 31 is formed on one side of cap 30, protruding upward so as to mate with the main body's carriage (not illustrated).

Head cartridge 21 includes heating device 27, with an array of heating elements for heating ink; nozzle 28, having a spray hole 29 with multiple orifices for spraying ink particles onto the print media by heating and vaporizing them; an electrode section, which is the means for furnishing electrical power to heating device 27; a flexible body in 24, for ink storage 23; and cap 30 attached to ink vessel body 22, which provides protection for flexible body 24. Ink particles, introduced to the heating elements of heating device 27, are vaporized by heat to produce a vapor pressure. This vapor pressure causes these ink particles to spray onto print media through spray hole 29. As a negative pressure acts on spray hole 29, by the meniscus phenomenon, the pressure on flexible body 24 that is being compressed to ink filter 26 causes a creation of positive pressure, atmospheric pressure, by a hole connected with the atmosphere so that ink particles are introduced to the heating elements of heating device 27 to use ink on print media.

When the ink in flexible body 24 is exhausted through a repetition of this cycle, a user separates head cartridge 21 from the carriage and replaces head cartridge 21 with new one, or refills the ink storage 23 through ink filling hole 25 located on cap 30. The ink-jet printer's head cartridge 21 is disposable, and parts other than head cartridge 21 may affect the life of the printer head. In general, the life of the head is the period between being mounted in the printer and its internal heating device's being damaged by chemical interaction and electrolytic actions with ink particles whereby the nozzle fails to spray ink particles. The heating device uses about 35 grams of the original 43 grams of ink, and 6 to 10 grams of ink remain on the flexible body. The head cartridge 21 is designed to be reused six times by refilling ink. However, the cartridge failures due to the spray hole being plugged by dirt may not be solved.

When the spray hole is plugged, the problem can be solved by suction pumping and forced spraying during the initial operating state. However, such a head cartridge is of a construction wherein ink is not refilled and is to be discarded, which creates a large expense. The disparity between the head's heating device and forcibly refilled similar ink causes poor-quality printing, thereby decreasing the reliability of the printer. In addition, the use of similar ink may damage the printer components.

Figure 2:
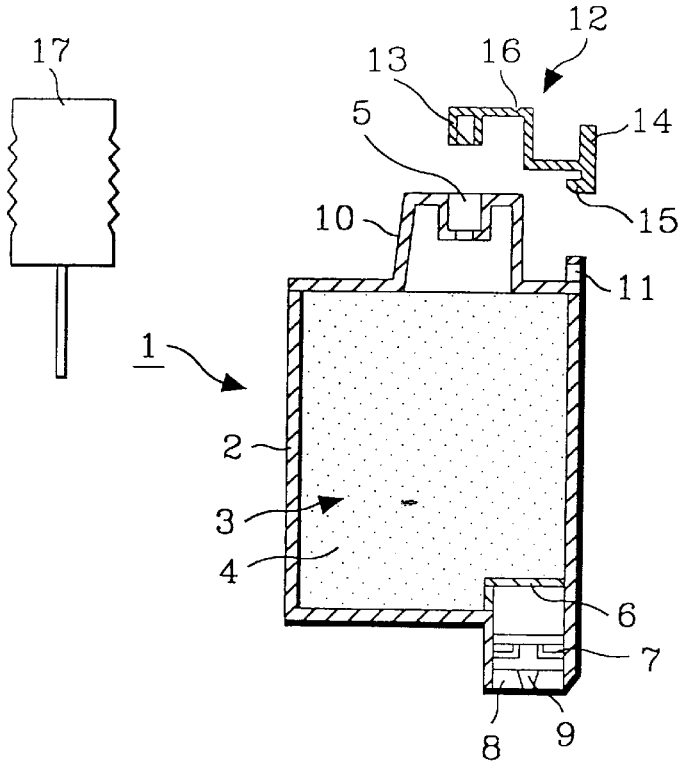
FIG. 2 depicts a head cartridge for an ink-jet printer in accordance with the present invention.
Figure 3:
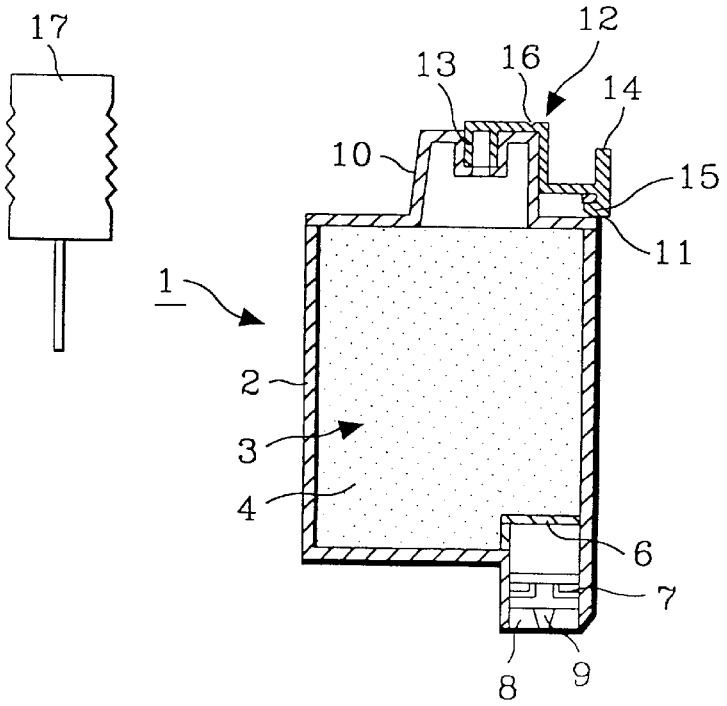
FIG. 3 depicts the combination of the inventive head cartridge and plug assembly in accordance with the present invention.

Turning to FIGS. 2 and 3, the ink jet printer cartridge of the present invention is shown. A head cartridge 1, for an ink-jet printer is attached to a carriage in the printer's main body, and has an ink storage 3 located inside an ink vessel body 2. Ink storage 3 includes a flexible body 4 for ink storage and ink conveyance, an ink filter 6 located on a lower portion inside of ink storage 3, a heating device 7 installed under ink filter 6 to heat and vaporize ink, and a nozzle 8 having a spray hole 9 for spraying ink particles onto the print media. An ink filling hole 5 and an opening 11 are formed on a cap 10 which is attached to ink vessel body 2 by an ultrasonic bonding process. On cap 10 is mounted a plug assembly 12 including a lid 13, for inserting into ink filling hole 5, and also including a locking portion 14 for locking the plug assembly 12 to the cartridge. More specifically, plug assembly 12 consists of lid 13 formed on one end to protrude downward, locking portion 14 formed on the other end to lock the plug assembly 12 to cap 10 of head cartridge 1, and a lug 15 under locking portion 14 which locks into opening 11. The lug 15 couples the plug assembly 12 to the head cartridge 1. Plug assembly 12 has a concave portion 16 on the top which is located away from lid 13 so as to facilitate mounting or removing plug assembly 12 from cap 10. Concave portion 16 is designed to be cut easily. The locking portion 14 locks the head cartridge 1 to the carriage of the printer's main body.

Ink storage 3 holds flexible body 4 and ink. A sponge serves as flexible body 4. Ink filing hole 5 may be used as an air hole, and an extra air hole may be formed on cap 10 for equalizing the internal pressure with atmospheric pressure. Ink filling hole 5 is of 1 to 5 millimeters (mm) in diameter, though 1.5 millimeters is the optimum size. The ink filling hole 5 can be used as an air hole because the lid 13 is formed to be inserted into ink filling hole 5 in a manner which leaves a gap between lid 13 and an inner wall of ink filling hole 5. The gap is too small to allow dirt into the cap 10 and is large enough to allow air to pass into and out from cap 10.

The following description relates to the operation and effect of the present invention as shown in FIGS. 2 and 3. Head cartridge 1 includes: heating device 7, with multiple of heating elements for heating ink; nozzle 8, having a spray hole 9 with multiple of orifices for spraying ink particles onto the print media, and electrical contacts for supplying energy to heating device 7. Head cartridge 1 also includes: ink filter 6, for filtrating the ink flowing into heating device 7; flexible body 4 for storing ink in ink storage 3, and cap 10 fixed to the top of ink vessel body 2 which provides protection for flexible body 4. Plug assembly 12 is mounted on cap 10, and its lid 13 fits into ink filling hole 5 and lug 15 mates with opening 11 of cap 10. Locking portion 14 of plug assembly 12 securely couples with the carriage.

Figure 4:
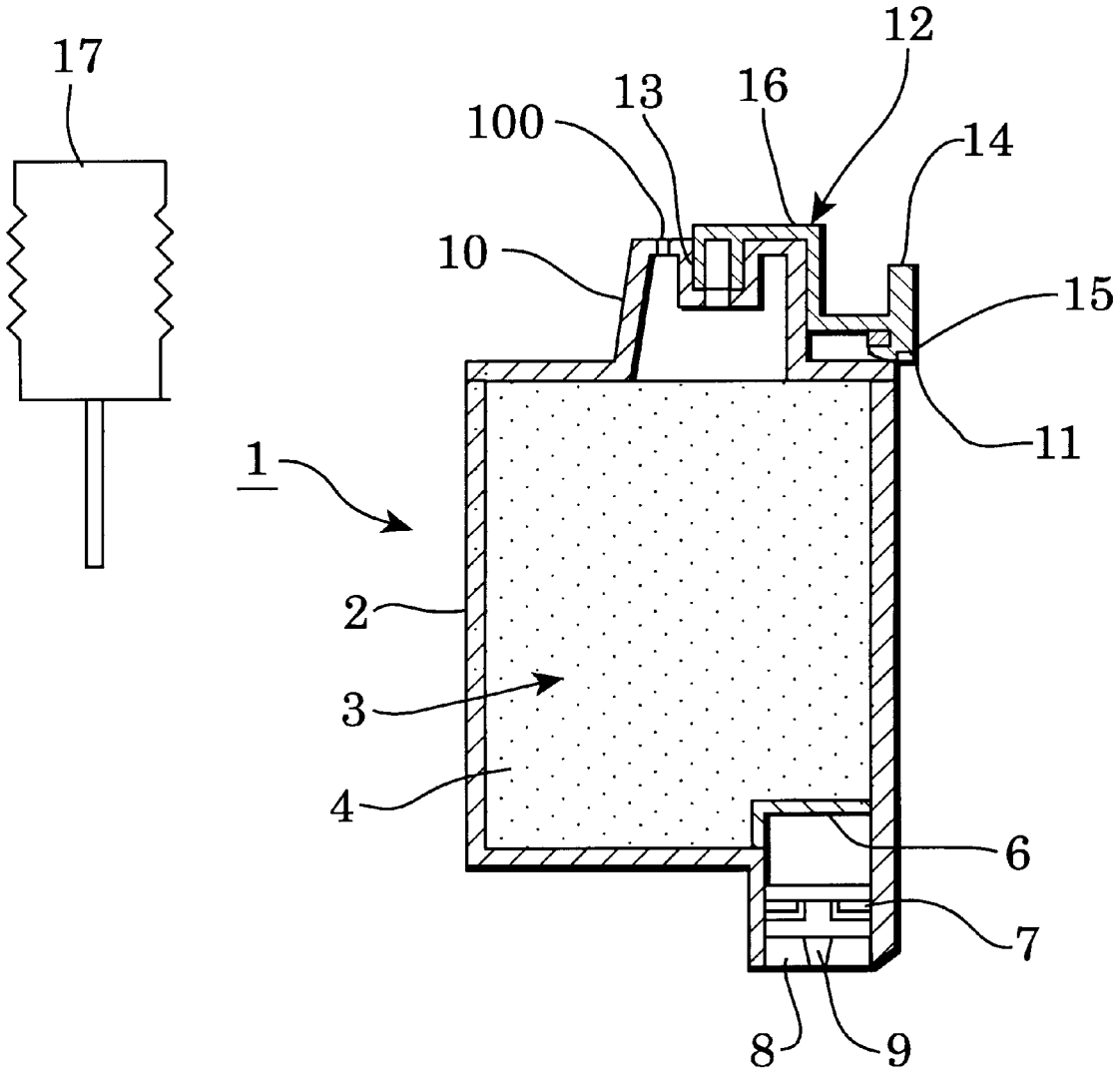
FIG. 4 depicts a detailed view of an air hole, in accordance with the principles of the present invention.

In head cartridge 1, the ink flowing into the heating elements of heating device 7, is vaporized by the heat, and the vapor pressure created at the time of the vaporization, forces ink particles to spray onto the print media through spray hole 9. Simultaneously, a negative pressure is created by the meniscus phenomenon around spray hole 9, the pressure acting on flexible body 4 that is being compressed to ink filter 6 causes a creation of positive pressure, atmospheric pressure, by an air hole connected with the atmosphere, which makes ink particles contained in flexible body 4 be introduced to heating device 7's heating elements thereby being sprayed on print media through spray hole 9 of nozzle 8. Turn now to FIG. 4, which shows a detailed view of an air hole, in accordance with the principles of the present invention. The FIG. 4 shows air hole 100 having a size allowing air to pass while not allowing contaminants to pass.

A predetermined amount of the ink of flexible body 4 is used by the repetition of the above cycle, thereby giving rise to deletion of characters during printing. At this point, if head cartridge 1 is not removed from the main body's carriage, lid 13 can be separated from plug assembly 12 by cutting along groove 16 in plug assembly 12 so that locking portion 14 of plug assembly 12 is easily detached from the printer's carriage, and head cartridge 1 is then removed therefrom to refill ink through ink filling hole 5 using ink injector 17. The groove 16 is loaded with tension.

When the ink in head cartridge 1 is used up, head cartridge 1 is separated from the main body's carriage, and plug assembly 12 is removed from cap 10. If 30 to 35 grams ink, the amount of ink used, is injected, using ink injector 17, through ink filling hole 5, it is delivered to and held in flexible body 4 by capillary action. If excess ink is injected to ink storage 3, it overflows through spray hole 9 of nozzle 8. Therefore, refilling ink that is just as much as the amount of ink used in flexible body 4 can prevent overflow of ink and contamination, and it is good to refill ink with the application of a tape to spray hole 9 of heating device 7.

After refilling head cartridge 1, plug assembly 12 plugs ink filling hole 5 by inserting lug 15, of plug assembly 12, into opening 11. If head cartridge 1 is reinstalled in the printer after removing tape applied to spray hole 9, it is initialized by suction pumping and forced spraying at its initial operating state. The lid 13 of plug assembly 12 is inserted into the ink filling hole 5 to prevent dirt and dust from getting into ink storage 3, thus avoiding the cartridge failure due to clogging of spray hole 9. In addition, a user purchasing the inventive head cartridge 1, conveniently, also has several ink injectors for further refilling the cartridge.

As described above, the invented head cartridge for an ink-jet printer, mounted on the printer's carriage, has a plug assembly designed to be inserted into the ink filling hole, thus preventing cartridge failure due to dirt and dust. Once the head cartridge is empty, the head cartridge is reused by refilling the proper amount of ink using an ink injector through the ink filling hole after removing the plug assembly, which assures a long life for the head cartridge. Moreover, selling the invented head cartridge along with the ink injector may offer great convenience and cost-effectiveness.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An apparatus, comprising:

a printer body;

a carriage being located inside said printer body; and a head cartridge being attachable to said carriage, said head cartridge comprising:

an ink vessel body storing ink;

a cap being attached to said ink vessel body, said cap being perforated by an air hole allowing ambient gas to pass to and from said ink vessel body and being perforated by an ink filling hole separately located from said air hole;

a print head being attached to said ink vessel body, and a plug assembly being mounted on said cap to plug said ink filling hole to prevent contaminants from entering said ink vessel body, said plug assembly including a lid removably inserted into said ink filling hole, said plug assembly forming a groove across a surface so that said plug assembly can be easily mounted to and removed from said cap, said plug assembly removably coupling said head cartridge to said carriage, said concave groove being formed to be cut easily.

2. The apparatus of claim 1, said plug assembly further comprising mounted to and removed from said cap, said concave groove of said plug assembly being formed to be cut easily.

3. The apparatus of claim 2, further comprising said lid being in a closed position when said lid inserts into said ink filling hole, and said lid being in an open position when said lid does not insert into said ink filling hole.

4. The apparatus of claim 3, further comprising said air hole being aligned parallel to said ink filling hole.

5. The apparatus of claim 3, further comprising said air hole being located near to said ink filling hole.

6. The apparatus of claim 2, said plug assembly further comprising a locking portion coupling said head cartridge to said carriage of said printer body.

7. The apparatus of claim 1, further comprising said air hole preventing contaminants from passing to said ink vessel body.

8. An apparatus, comprising:

a printer body;

a carriage being located inside said printer body;

an ink vessel body storing ink therein, said ink vessel body being attachable to said carriage;

a flexible body being installed inside said ink vessel body to hold and deliver said ink;

an ink filter being located inside said ink vessel body adjacent to said flexible body;

a heating device having heating elements disposed adjacent to said ink filter to heat and evaporate said ink;

a nozzle having a spray hole with multiple orifices for spraying said ink onto a recordable medium to form an image on the recordable medium, wherein said nozzle is adjacent to said heating device; and a cap being attached to said ink vessel body, said cap being perforated by an ink filling hole and by an aperture for a plug, said cap being perforated by an air hole allowing ambient gas to pass to and from said ink vessel body, said air hole being separately located from said ink filling hole and said aperture; and a plug assembly having a lid for plugging said ink filling hole and a lug for attaching said plug assembly to said cap via said aperture in said cap, said lid and said lug being mounted to said cap, said plug assembly preventing contaminants from entering said ink vessel body, said lid being in a closed position when said lid inserts into said ink filling hole, said lid beg in an open position when said lid does not insert into said ink filling hole, said plug assembly forming a concave groove across a surface so that said plug assembly can be easily mounted to and removed from said cap, said plug assembly removably coupling said ink vessel body to said carriage, said concave groove of said plug assembly being formed to be cut easily.

9. The apparatus of claim 8, further comprising said aperture of said cap being located on one side of said cap so that said lug on said plug assembly fits into said aperture, locking said plug assembly securely to said cap.

10. The apparatus of claim 8, further comprising a sponge serving as said flexible body for said ink.

11. The apparatus of claim 8, further comprising said air hole preventing contaminants from passing to said ink vessel body.

12. The apparatus of claim 8, said ink filter further comprising a very fine mesh to filtrate substances other than ink.

13. The apparatus of claim 8, said ink filling hole further comprising a size being 1 to 5 millimeters in diameter, wherein 1.5 millimeters corresponds to an optimum size.

14. The apparatus of claim 8, said air hole equalizing a pressure inside said cap with atmospheric pressure when said plug assembly prevents contaminants from entering said ink vessel body.

* * * * *